United States Patent [19]

Cloyd

[11] 3,973,692

[45]*Aug. 10, 1976

[54] INJECTION MOLDED FOLDING BOX

[75] Inventor: Harold S. Cloyd, Erie, Pa.

[73] Assignee: Nosco Plastics, Inc., Erie, Pa.

[ * ] Notice: The portion of the term of this patent subsequent to Jan. 7, 1992, has been disclaimed.

[22] Filed: Dec. 24, 1974

[21] Appl. No.: 536,085

Related U.S. Application Data

[63] Continuation-in-part of Ser. No. 390,920, Aug. 23, 1973, Pat. No. 3,858,745.

[52] U.S. Cl. ..... 220/7; 220/62

[51] Int. Cl.[2] ..... B65D 7/24

[58] Field of Search ..... 220/7, 6, 17.1, 18, 220/62; 229/16 R, 30, DIG. 11

[56] References Cited

UNITED STATES PATENTS

| | | | |
|---|---|---|---|
| 1,142,017 | 6/1915 | Brown | 229/30 X |
| 3,330,437 | 7/1967 | Bellamy | 220/6 X |
| 3,497,127 | 2/1970 | Box | 220/6 X |
| 3,858,745 | 1/1975 | Cloyd | 220/7 |

*Primary Examiner*—William Price
*Assistant Examiner*—Steven M. Pollard
*Attorney, Agent, or Firm*—Ralph Hammar

[57] ABSTRACT

A box which can be injection molded flat, erected in the field, and when empty knocked down for return shipment. Features include improved structure for holding the parts assembled and for withstanding the stresses of handling, shipping and storage.

10 Claims, 20 Drawing Figures

INJECTION MOLDED FOLDING BOX

This application is a continuation in part of Application Ser. No. 390,920, filed Aug. 23, 1973, now U.S. Pat. No. 3,858,745 incorporated by reference.

This invention is a box injection molded flat as a single piece of flexible thermoplastic (polyethylene, polypropylene, etc.) having bottom, top, side and end panels hinged together. The box is erected by folding or swinging the panels into position and connecting adjacent panels by fasteners which tighten under the stresses encountered during handling, shipping and storage. The side and end panels have feet which transmit the gravity load and thereby take the load off the hinges. The fasteners are easily released to permit return of the box to the flat state to reduce the shipping charges for returning empty containers. The fasteners may also fasten internal partitions.

In the drawing,

FIG. 1 is a diagrammatic plan view of a preferred form of blank from which the box is erected;

FIGS. 2, 3 and 4 are enlarged sections on lines 2—2, 3—3 and 4—4 of FIG. 1;

FIG. 5 is a section through one of the fasteners which hold the sides and ends of the box together, the fastener being shown in the assembled or locking position;

FIGS. 6 and 7 are corresponding sections of the individual parts of the FIG. 5 fastener on lines 6—6 and 7—7 of FIG. 1;

Figure 1:
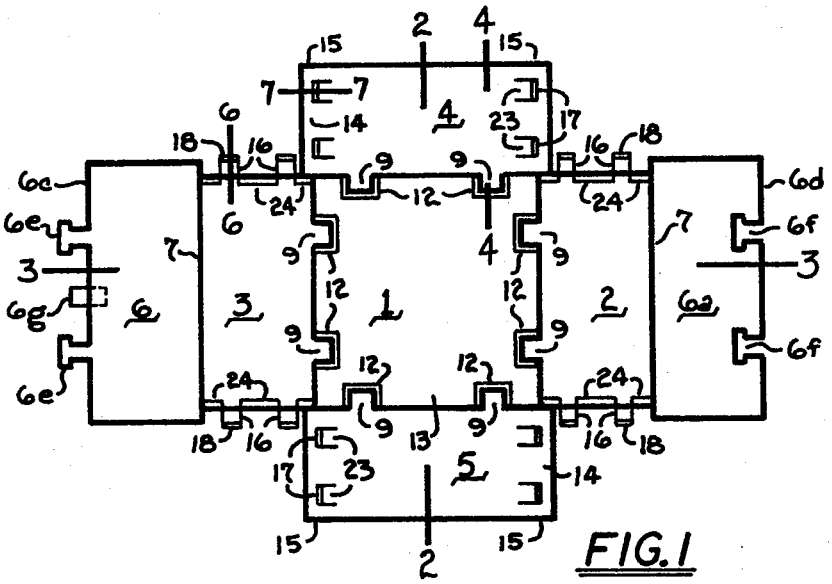
Figure 10:
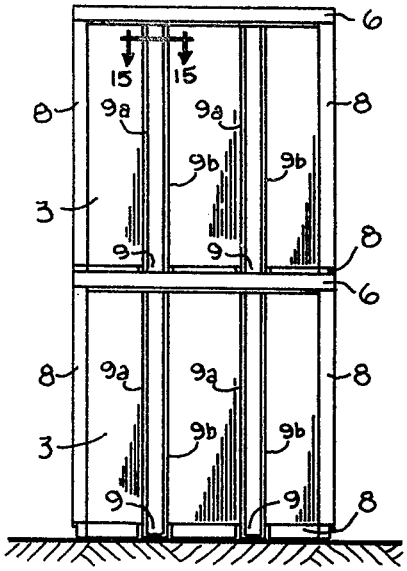
FIG. 10 is a side elevation of two boxes stacked one on top of the other.
Figure 11:
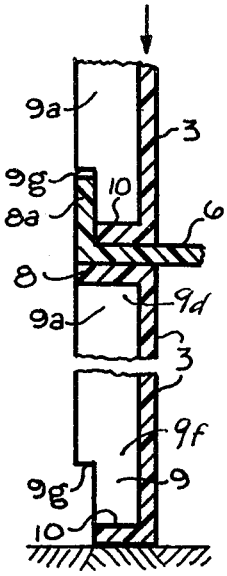
FIG. 11 is a fragmentary view showing the structure for transmitting load from an upper container to the next lower container in a stack.
Figure 12:
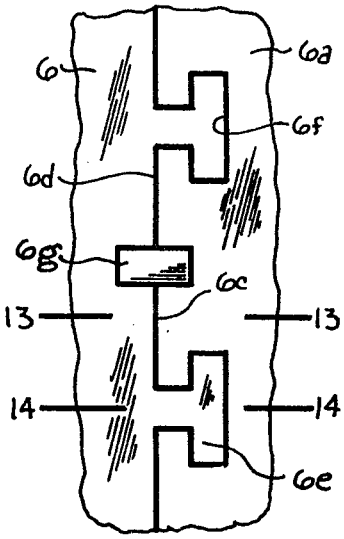
FIG. 12 is a top plan view of the adjacent edges of the cover of the box.
Figure 13:
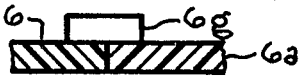
Figure 16:
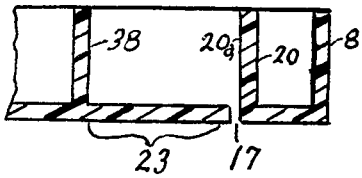
Figure 14:
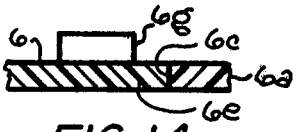
Figure 17:
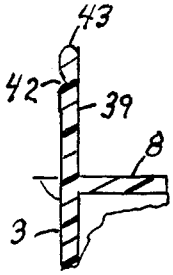
Figure 18:
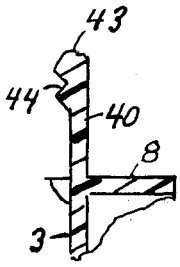
Figure 15:
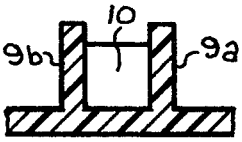
Figure 20:
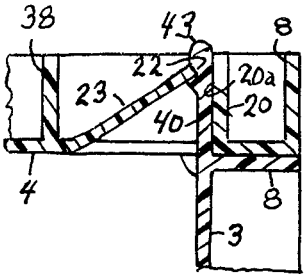
Figure 19:
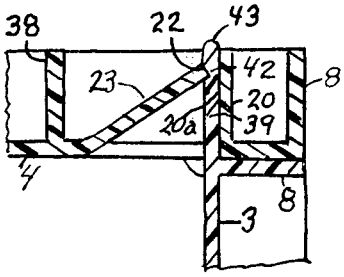

FIGS. 13 and 14 are sections on lines 13—13 and 14—14 of FIG. 12;

FIG. 15 is a section on line 15—15 of FIG. 10;

FIG. 16 is a section of line 7—7 of FIG. 1 showing a modification of one of the parts for holding the sides and ends of the box together;

FIGS. 17 and 18 are sections of modifications of fastner parts cooperating with the part shown in FIG. 16;

FIGS. 19 and 20 are sections of the fastners in FIGS. 16–18 in the assembled or locking position.

The blank for the FIGS. 1–15 box is molded flat as shown in FIG. 1 and comprises a bottom wall 1, side walls 2, 3, end walls 4, 5, and a top wall or cover 6, 6*a*. The terms bottom, top, side and end are used to identify the walls in the particular structure and are not limitations. Each of these walls consists of a single, generally flat, plastic panel which may be imperforate, as shown, or which may contain openings or perforations for ventilation or for reducing the amount of material required. The panels may have walls of uniform thickness, as shown, or may be ribbed on one or both surfaces to increase the structural rigidity. The inner surfaces of the panels may be smooth, as shown, or may have any other surface treatment desired. None of these modifications affect the basic simplicity of molding the blank. While the side and end panels are shown as rectangular, other polygonal shapes which can be folded, e.g. trapezoidal, may be used. The rectangular panels result in a container with all walls at right angles to each other. Non-rectangular panels can result in some walls which are not at right angles to adjacent walls.

Figure 2:
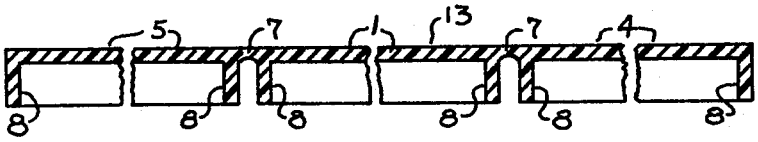
Figure 3:
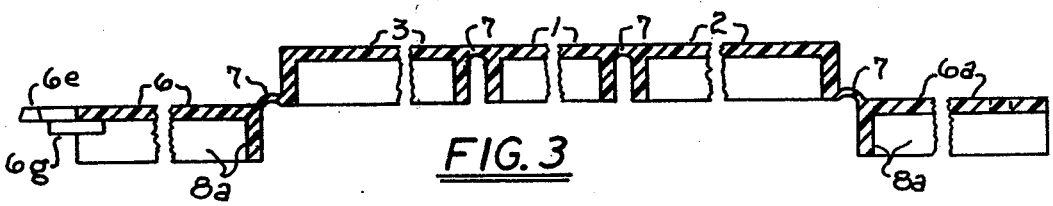

The side and end panels 2–5 are hinged to adjacent edges of the bottom panel 1. The top panel or cover is in two sections 6, 6*a*, each hinged to the adjacent edge of one of the end and side panels, for example the panels 2, 3 as shown in FIG. 3. The hinges as shown in FIGS. 2 and 3 consist of weakened or thin flexing sections 7 which have sufficient flexibility to permit required hinging of the panels from the flat position shown in FIGS. 1, 2 and 3 to the erected position shown in FIGS. 4 and 10. The outer surface of each of the bottom, side and end panels is bordered by outstanding peripheral ribs 8 which rigidify the edges of the panels. As shown in FIG. 2, the hinges 7 are arranged between adjacent ribs 8.

The cover sections 6 and 6*a* do not need ribs on the edges 6*c*, 6*d* which meet in the closed position as shown in FIG. 12, although such ribs could be used. The other three edges of the cover sections have depending ribs 8*a* as shown in FIG. 3. The edges 6*c*, 6*d* of cover section 6 have interlocking projections 6*e* and openings or recesses 6*f* which dovetail in the closed position of the cover and tie the cover sections together. The mating edges of the projections and recesses 6*e*, 6*f* may have a wedge or equivalent fit (FIG. 14) to prevent accidental displacement. A stop 6*g* on one of the cover sections (e.g. 6) limits penetration of the projections 6*e* and thereby prevents pushing the projection through the openings 6*f*. When the projections and openings are engaged, movement of the cover sections 6, 6*a* relative to each other is prevented. Also, the cover sections when interlocked resist deflection or movement of the wall sections 2, 3 to which the cover sections are hinged.

Figure 4:
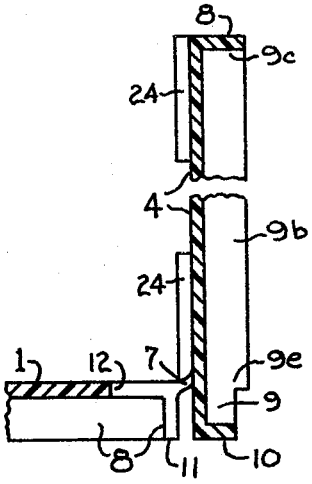

At the lower edge of each of the side and end panels 2–5 inclusive are integral projecting feet 9 which project from the lower edges of the panels a distance substantially equal to the projection of the peripheral ribs 8. Each of the feet is coplanar with its panel and as molded is coplanar with the bottom panel 1. When the panels are swung to the erected position as shown in FIG. 4, the lower edge 10 of each of the feet 9 is in the same plane as the lower edges 11 of the peripheral ribs 8 on the bottom panel 1. This means that load on the bottom panel 1 is transmitted from the bottom panel to the lower edges 11 of its peripheral ribs 8 and load on the side and end panels such as would be transmitted from upper to lower boxes when boxes are stacked one on top of the other as shown in FIG. 10 is transmitted directly from the side and end panels to the feet. To insure direct transmission of load to the feet 9 vertical ribs 9*a*, 9*b* are molded integral with the side and end panels and have upper ends 9*a*, 9*d* integral with the ribs 8 at the top of the panels and lower ends 9*e*, 9*f* integral with the feet as shown in FIGS. 4, 10, 11 and 15. This eliminates all possible loading stress on the hinges 7.

In order to accomodate the feet 9, each of the edges of the bottom panel 1 is notched as indicated at 12 to receive the feet of the adjacent side or end panel as the case may be. Each foot 9 and each notch 12 interrupts the hinge section 7. In the particular construction shown in FIG. 1 where there are two supporting feet 9 for each of the side and end panels, there are three hinge sections 7 between each of the side and end panels and the adjacent edge of the bottom panel.

Figure 5:
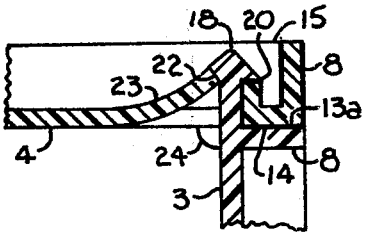

When the side panels 2, 3 and the end panels 4, 5 are swung to the erected position at right angles to the inner surface 13 of the bottom panel 1, outer surfaces 13*a* on the vertical ribs 8 of the side panels register with and abut surfaces 14 on projections 15 of the end panels, and the panels are fastened in that position by tabs or projections 16 on the side panels which are received in slots 17 in the end panels. As shown in FIG. 5, each of the tabs 16 is a direct extension of the walls of the associated side panel 3 (or 2). The projections 16 are of generally rectangular shape and are spaced apart so as to register the erected position with the slots 17 in the end panels 4, 5. Each projection 16 terminates in a cam faced head 18 having on one side a locking shoulder 19 which engages a detent surface 20 on the end panel as shown in FIG. 5. The other side of the head 18 has an inclined locking surface 21 which in the engaged position shown in FIG. 5 engages the end surface 22 of flexible tab 23 in the end panel. In the assembly, the side panel 3 (or 2) is first swung to the upright position at right angles to the bottom panel 1 and the end panel 4 (or 5) is then swung to the upright position. As the end panel approaches the upright position, the projections 16 enter the slots 17 and the cam faced heads 18 push the flexible tabs 23 outward. The flexible tabs 16 are themselves bent or cammed as the heads 18 enter the slots. Upon being fully received in the slots 17, the locking shoulders 19 on the projections 16 snap over the locking shoulders 20 and the ends 22 of the tabs 23 seat against locking shoulders 21. In this position tension forces tending to pull the tabs 16 out of the slots 17 merely result in tighter engagement of the locking shoulders 19, 21 with the shoulders 20, 22. The width of the slots 17 is less than the thickness of the projections 16. The surface 20*a* of the stop 20 and the end surface 22 of the tab cooperate to center the projections 16 in the slots 17. Compression forces tending to force the tabs further into the slots 17 are resisted by engagement of the surface 13*a*, 14 and by engagement of stops 24 with the inner surfaces of the end panels 4, 5. In the locked position, the abutting surfaces of the end and side panels are rigidified by the peripheral ribs 8. The resultant connection between the side and end panels is capable of withstanding all of the stresses encountered during handling, shipping and storage. There is no way that the tabs 16 can accidentally pop out of the slots 17.

To disassemble the box and return it to the flat condition of FIG. 1, it is only necessary to pry the tabs 16 clear of the locking shoulders 21, after which the side and end panels may be readily separated.

In some cases the erected box may be an open topped container, in which case the cover or top panel sections 6, 6*a* will be omitted. After erection of the side and end panels, the cover sections are swung over the top of the container and locked in place by interlocking projections and openings 6*e*, 6*f*. The projected area of the cover 6, 6*a* as shown in FIG. 1 is larger than the projected area of the bottom panel 1 by an amount equal to the projection of the peripheral ribs 8 on the side and end walls. In the assembled position as shown in FIG. 10 the cover 6, 6*a* accordingly registers with the outer surface of the erected container. The lower ends of the feet 9 and of the associated ribs 9*a*, 9*b* are notched as shown at 9*g* in FIG. 11 so as to be received within the peripheral ribs 8*a* of the cover 6, 6*a*. This centers the boxes in the stack. When stacked one on top of the other, the gravity load from an upper container is transferred to its bottom panel and from the bottom panel to the cover 6, 6*a* of the next lower container which in turn transmits the load to the upper edges of the side and end panels of said next lower container. The load of upper containers in a stack accordingly is received by the side and end panels of lower containers which transmit the received load through the feet 9. This means that the side and end panels of a lower container in a stack must carry all of the load of containers above it in the stack.

Figure 7:
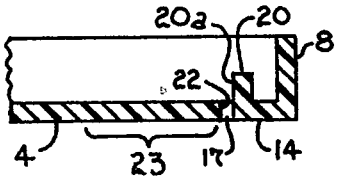
Figure 6:
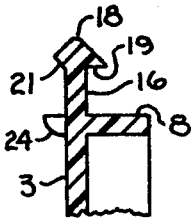
Figure 8:
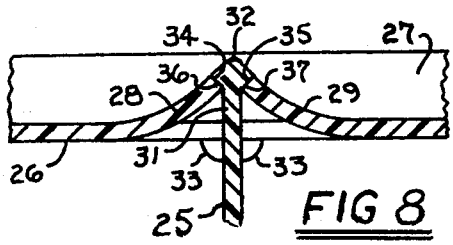
FIG. 8 is a sectional view of a fastner suitable for securing an internal partition to a wall of the box.
Figure 9:
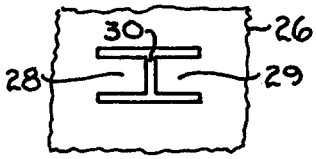
FIG. 9 is a plan view of a portion of a panel wall containing the tabs forming part of the FIG. 8 fastner.

FIGS. 8 and 9 show a modification of the fastener construction of FIGS. 5, 6 and 7 which is of particular utility in fastening an internal partition 25 to a wall 26 of a side or end panel 27. For this purpose, the wall 26 is provided with two flexible tabs 28, 29 spaced apart by a slot 30 and the partition 25 is provided with a flexible projection 31 of greater thickness than the width of the slot 30 and having a cam faced head 32 received in the slot 30 and having stops 33 which engage the wall 26 to positively limit the penetration of the projection 31 into the slot 30. In the fully engaged position (FIG. 8), the stops 33 are seated against the surface 26 of the panel 27 and locking surfaces 34, 35 on the under side of the head 32 are engaged with the end surfaces 36, 37 of the tabs 28, 29. As with the fastner of FIGS. 5, 6 and 7, tension forces in the direction to pull the projection 31 out of the slot 30 merely results in tighter engagement of the locking surface 34, 35 with the end surfaces 36, 37 of the tabs. Forces in the opposite or compression direction are positively resisted by the stops 33. Accordingly, stresses occurring during service cannot dislodge the connection between the partition 25 and the panel 27. However, by prying one of the tabs 28 or 29 clear of its associated locking projection 34 or 35, the partition 25 may be readily separated from the panel. While only one of the fastening connections is shown between the partition 25 and the panel 27, in normal practice there would be several of these fastening projections for each partition. By the use of such partitions, it is possible to make a bottle case with a wide variety of partitions which can be selected in accordance with the product demand. For example, the same basic case could be partitioned for individual bottles or for six-packs or for eight-packs, etc.

FIGS. 16 through 20 show modifications of the fasteners for holding the sides and the ends of the box together. These modifications are intended to make the box easier to disassemble.

Comparing FIG. 16 with FIG. 7, the height of the stop 20 has been increased and a stiffening rib 38 has been added at the base of tab 23.

Comparing FIGS. 17 and 18 with FIG. 6, the shoulder 19 has been eliminated so the projections 39, 40 which correspond to projections 16 are not required to flex during assembly of the box and the locking function is performed by the engagement of flat surfaces 41 of the projections with flat surface 20*a*.

The projection 39 has one side 41 flat for engaging flat surface 20*a* on stop 20 and its opposite side provided with an angular groove 42 receiving the end surface 22 of the tab 23. The thickness of the projection 39 is substantially uniform throughout its length and is greater than the width of the slot 17. The upper end of 43 may be desired shape since its sole function is to push the tab 23 outward as the projection is inserted into slot 17. The projection 40 shown in FIG. 19 has a flat side for engaging flat surface 20*a* and has a thick end 43 and a deeper groove 44 for receiving the end 22 of the tab 23.

The assembly and disassembly is the same as the box of FIGS. 1–9. Pushing the projections 39, 40 into slots 17 effects a positive connection. Deflecting the tabs 23 clear of the grooves 42 (44) unlocks the connections. The unlocking is easier because no deflection of the projections 39, 40 is required.

From one aspect, the modification of FIGS. 16–19 omits the shouler 19 and recesses the locking surface 21 into the head 18.

What is claimed is:

1. A box comprising first and second panels transverse to each other, the first panel having an edge transverse to and abutting a surface of the second panel, said first panel edge having a projection with a head extending through to the opposite surface of the second panel, said second panel having a slot receiving the projection and a tab with a free end at one side of the slot and with the opposite end of the tab joined to said second panel and the sides of the tab free to deflect relative to said second panel, said head extending through said slot and deflecting said tab, a shoulder on one side of the head engaging said first end of the tab with the tab in the deflected position, and a stop means on the opposite surface of said second panel engaging the opposite side of the head.

2. The box of claim 1 in which said first panel is a partition.

3. The box of claim 1 in which said stop means is on a rib on said opposite surface of said second panel.

4. The box of claim 3 in which said projection is held against said rib by said tab.

5. The box of claim 1 in which the projection is flexible.

6. The box of claim 1 having a bottom wall panel and in which one of said first and second panels is an adjoining side wall panel having adjacent peripheral edges joined by hinge means between said edges so the side wall panel may be swung from a knock down position generally coplanar with the bottom wall panel to an erected position transverse to said bottom wall panel, said peripheral edge of the bottom wall panel having a reentrant notch and said peripheral edge of the side wall panel having a projection extending below said hinge means and serving as a foot in the erected position.

7. The box of claim 6 in which the panels and hinge means are injection molded of a single piece of flexible thermoplastic and the hinge means comprises one or more thin flexing sections connecting said adjacent edges.

8. The box of claim 7 in which the hinge means is at the upper side of said edges and ribs project downward from the lower side of said edges.

9. The box of claim 8 in which the downward projection of said foot is substantially the same as the downward projection of said ribs.

10. The box of claim 1 having a bottom wall panel and in which said first and second panels are adjacent side wall panels joined to the bottom wall panel by hinge means so the side wall panels may be swung from a knock down position generally coplanar with the bottom wall panel to an erected position transverse to said bottom wall panel, said peripheral edge of the side wall panel having reentrant notches and said perepheral edges of the side wall panels having projections extending into said notches in the knocked down position and projecting downward below said hinge means and serving as feet in the erected position.

* * * * *